United States Patent [19]

Van Slyke

[11] 3,977,844

[45] Aug. 31, 1976

[54] PROCESS FOR PRODUCING A SULFUR FREE COMBUSTIBLE GAS

[76] Inventor: William J. Van Slyke, 2549 Harris Ave., Richland, Wash. 99352

[22] Filed: May 9, 1973

[21] Appl. No.: 358,506

[52] U.S. Cl. ..... 48/202; 48/203; 48/206; 48/209; 252/373; 423/244

[51] Int. Cl.[2] ..... C10J 3/16; C10J 3/54

[58] Field of Search ..... 48/197 R, 202, 206, 48/203, 128, 209; 423/208, 242, 244; 252/373; 110/1 J, 31; 122/5

[56] References Cited

UNITED STATES PATENTS

| | | | |
|---|---|---|---|
| 1,220,989 | 3/1917 | Huber et al. | 423/208 |
| 1,948,085 | 2/1934 | White et al. | 48/203 |
| 2,807,529 | 9/1957 | Tarbox | 48/206 |
| 2,830,883 | 4/1958 | Eastman | 48/206 |
| 2,941,877 | 6/1960 | Grahame | 48/196 |
| 3,189,408 | 6/1965 | Miller | 423/208 |
| 3,463,623 | 8/1969 | Forney et al. | 48/202 |
| 3,481,834 | 12/1969 | Squires | 201/17 |
| 3,524,720 | 8/1970 | Bauer | 423/244 |
| 3,544,263 | 12/1970 | Ninomiya et al. | 423/244 |
| 3,597,327 | 8/1971 | Squires | 201/12 |
| 3,599,610 | 8/1971 | Spector | 110/31 X |
| 3,607,157 | 9/1971 | Schlinger et al. | 48/206 |
| 3,655,331 | 4/1972 | Seglin et al. | 23/63 |
| 3,769,197 | 10/1973 | Leas et al. | 48/197 R |
| 3,784,676 | 1/1974 | Moss | 48/212 |
| 3,804,606 | 4/1974 | Archer et al. | 48/197 R X |
| 3,807,090 | 4/1974 | Moss | 48/128 |
| 3,823,676 | 7/1974 | Cook et al. | 110/1 J |

FOREIGN PATENTS OR APPLICATIONS

| | | |
|---|---|---|
| 1,183,937 | 3/1970 | United Kingdom |

*Primary Examiner*—S. Leon Bashore
*Assistant Examiner*—Peter F. Kratz
*Attorney, Agent, or Firm*—Littlepage, Quaintance, Murphy & Dobyns

[57] ABSTRACT

A process for producing hot combustible gas free of sulfur, halogens and particulate matter. The process comprises passing oxygen, steam and/or carbon dioxide through a reaction zone containing an alkali or alkaline earth metal oxide, hydroxide, bicarbonate or carbonate and a carbonaceous fuel such as coal. The sulfur and halogen in the carbonaceous fuel are removed resulting in a combustible gas substantially free of sulfur, halogens and particulate matter.

4 Claims, 1 Drawing Figure

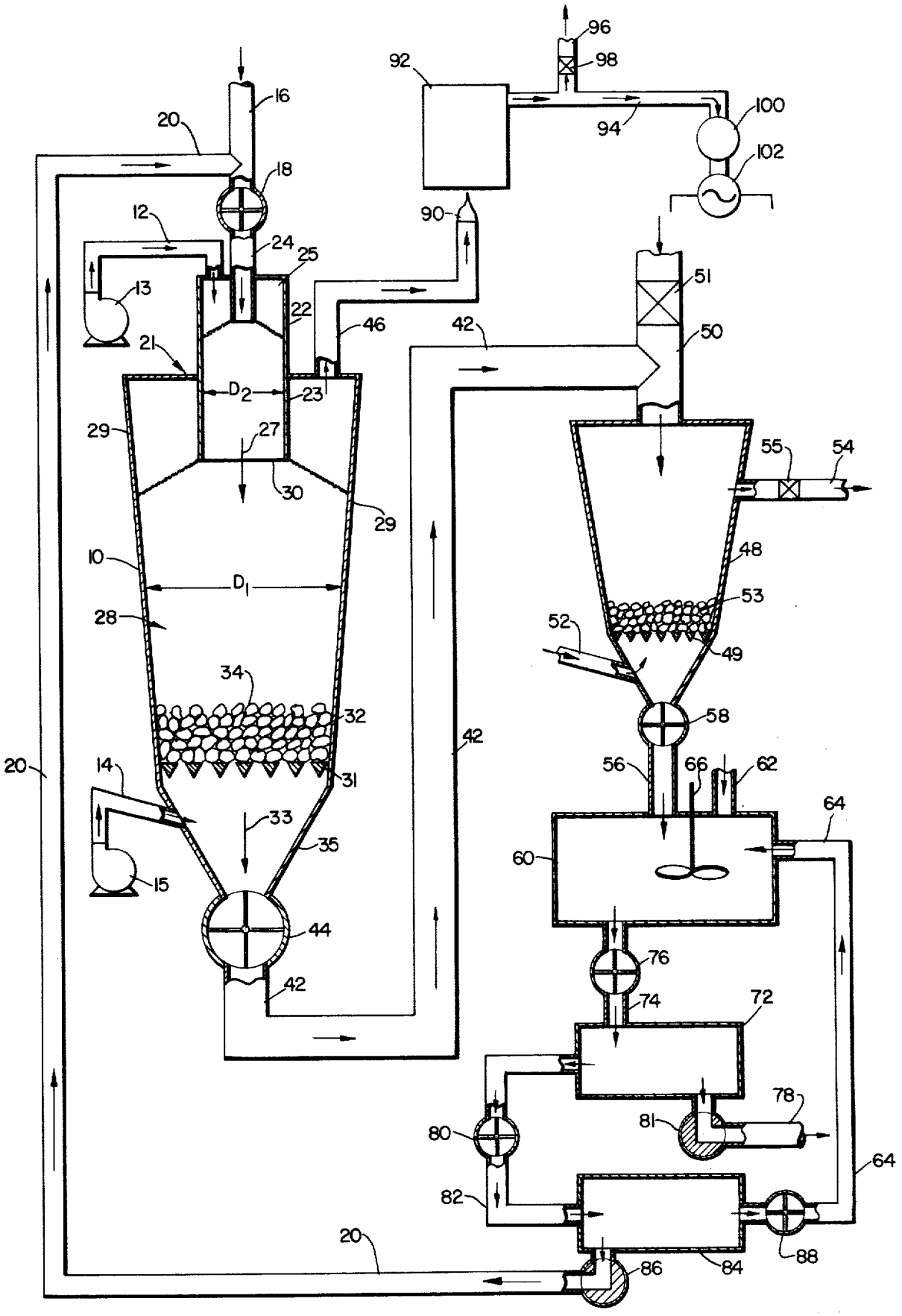
96
98
92
16
100
20
94
102
18
90
12
24
25
51
13
22
46
42
50
21
D2
23
29
27
55
54
30
29
48
10
D1
53
28
52
49
34
32
58
42
20
14
56
66
62
31
64
33
35
60
15
44
76
42
74
72
78
80
81
64
82
20
88
86
84

PROCESS FOR PRODUCING A SULFUR FREE COMBUSTIBLE GAS

There is a long felt need in the art for the elimination of sulfur from combustion products such as stack gases. There have been numerous attempts by others to eliminate this sulfur which is frequently present in stack gases in the form of hydrogen sulfide, sulfur dioxide, and/or sulfur trioxide. Most of the attempts by others have been directed towards the removal of the above-described compounds of sulfur from the combustion products. See for example Grantham U.S. Pat. No. 3,438,728 and Heredy et al. U.S. Pat. No. 3,438,722, both of which describe a process for the absorption of hydrogen sulfide from stack gases in molten sodium carbonate. These processes have met with only very limited commercial success because of the problems inherent in maintaining and operating a process employing a molten salt, and because of the high temperatures which are necessary in order to maintain the salt in its molten state. An additional problem occurs when the salt inadvertently cools and solidifies in the absorption system.

It has also been proposed to employ aqueous solutions of sodium carbonate for the sorption of hydrogen sulfide from stack gases. Such a process is described in Eastman U.S. Pat. No. 2,830,883. However, this process has the disadvantage of requiring the handling of large amounts of liquid.

Both the molten salt processes of Grantham and Heredy and the carbonate solution process of Eastman have the inherent disadvantage of permitting the release of hydrogen sulfide to the atmosphere when either of the processes fails for any reason.

Apart from the additional expenditure and special maintenance, the high pressure equipment suffer from the disadvantage of carrying off solid particles with the product-gases from the reactor. In the case of fuel gas, this warrants a solids-filter before passing it on to the burner, otherwise it results in fire hazards through clogging of burners and other parts of the equipment.

Accordingly, it is an object of the present invention to provide an improved process for the elimination of sulfur, halogens and particulate matter which is substantially free of the disadvantages of prior processes.

Another object is to provide a process for producing hot combustible gas free of sulfur, halogens and particulate matter.

A further object is to provide a process for removing sulfur before the formation of compounds of sulfur in stack gases.

A still further object is to provide an improved process for removing sulfur which does not require the use of molten salt absorbance.

Yet another object is to provide an improved process which does not require the use of aqueous solutions of sodium carbonate.

Still another object is to provide an improved process capable of operation at atmospheric pressure.

Still another object is to provide an improved process which produces a compound of sulfur in a usable form.

Still another object is to provide an improved process which utilizes hot combustible gas in a manner which substantially eliminates heat loss.

Still another object is to provide a novel reactor which is useful in the present process as well as in other processes.

Still another object is to produce combustible gases from various organic scrap materials, municipal refuse, solid organic refuse contaminants with radioactive materials, paper industry refuse, as well as photographic scrap.

Still another object is to eliminate atmospheric pollutants such as sulfur, halogens particulate matter and heat from stack gases evolved during incineration of municipal refuse, photographic film, organic refuse from radioactive plants, paper industry refuse, stack gases from industrial furnaces, and fuel gases produced from sulfur contaminated carbonaceous fuel such as coal.

Still another object is to produce a hot combustible gas having a low BTU content of 10 to 400 BTU/ft$^3$ and preferably of 200 to 300 BTU/ft$^3$.

Additional objects and advantages of the present invention will be apparent to those skilled in the art by reference to the following detailed description thereof and the drawing wherein there is schematically shown an apparatus suitable for practicing the process of the present invention.

According to the invention there is provided a process for producing hot combustible gas free of sulfur, halogens and particulate matter. The process comprises passing oxygen and a gas selected from the group consisting of steam, carbon dioxide and mixtures thereof through a reaction zone containing an oxide, hydroxide, bicarbonate, or carbonate of an alkali metal or an alkaline earth metal. The reaction zone also contains a carbonaceous fuel containing contaminating amounts of sulfur. The process is practiced under conditions such that substantially all of the sulfur in the carbonaceous fuel forms metal sulfide. The oxygen, steam, and/or carbon dioxide and carbon which is present in the carbonaceous fuel form a hot combustible gas mixture comprising hydrogen and carbon monoxide. This combustible gas mixture is substantially free of sulfur, halogens and particulate matter. Substantially all of the sulfur originally present in carbonaceous fuel is removed from the reaction zone as the metal sulfide.

The preferred means by which sulfur-free hot combustible gas is produced and by which the sulfur is caused to form the metal sulfide are by maintaining the reaction zone at a temperature of 700° to 900° and preferably 750° to 850°C and under a pressure of 0 to 100 psig and preferably 0 to 50 psig. At temperatures much below this range the undesirable formation of hydrogen sulfide is favored, whereas at temperatures above 900°C the following disadvantages are encountered. (1) An enormous increase in sodium vapor pressure results in excessive sodium losses with the fuel gas. This could cause higher sodium carbonate makeup requirements, sulfur losses and possibly result in corrosion of heat exchanger tubing. (2) An undesirable softening of ash which results in problems of maintaining the sodium carbonate where it is needed and also potential chemical attack of the reactor walls. (3) At operating temperatures higher than 900°C the reactor must be provided with an expensive reactor lining.

The preferred means by which the temperature is maintained in the above range is by adding water vapor and/or by recycling carbon dioxide to the reaction zone. The water vapor and/or carbon dioxide endothermically react with carbon to consume heat evolved from other exothermic reactions, thus maintaining the temperature within the desired range. The water vapor and/or carbon dioxide is supplied at a rate sufficient to maintain the temperature within the desired range and generally in a molar ratio of water vapor and/or carbon dioxide to carbon in carbonaceous fuel of between 1:50 and 1:200.

According to a preferred embodiment of the present invention, the reaction zone is contained within a reactor of unique design. This reactor has a countercurrent section, the upper end of which has a solids inlet and a gas inlet. This countercurrent section is mounted below a cocurrent section which has a solids inlet and is in communication with it. The countercurrent section has a gas inlet at its lower end and the cocurrent section has a gas inlet at its upper end. The fuel gas is removed from the reactor from the upper end of the countercurrent section. In the process of the present invention, the solids and a portion of the gaseous mixture are charged to the cocurrent section, whereas the balance of the gaseous mixture is charged to the countercurrent section of the reactor.

Although any oxide, hydroxide, bicarbonate or carbonate of any alkaline metal or alkaline earth metal can be employed, the preferred compounds are calcium oxide, calcium hydroxide, calcium bicarbonate, calcium carbonate, magnesium oxide, magnesium hydroxide, magnesium bicarbonate, magnesium carbonate, strontium carbonate, barium hydroxide, potassium oxide, potassium hydroxide, potassium bicarbonate, potassium carbonate, sodium oxide, sodium hydroxide, sodium bicarbonate, and sodium carbonate which is preferred because of cost, availability, and reactivity.

According to the broadest aspects of the present invention, the process is applicable to any carbonaceous fuel which contains contaminating amounts of sulfur and/or halogens and/or which tends to release the particulate matter during incineration. Examples of such carbonaceous fuels include among others bituminous coal, anthracite coal, peat, coke, various organic scrap materials, municipal refuse, solid organic refuse contaminants with radioactive materials, paper industry refuse, as well as photographic scrap. In short, the process is particularly applicable to any solid carbonaceous fuel.

Applicant does not claim to be the first to pass oxygen and steam through a mixture of coal and sodium carbonate. Such a process is disclosed in White et al. U.S. Pat. No. 1,948,085, hereinafter White. However, White does not disclose the present invention and fails completely to remove sulfur from the fuel gas which he produces. In order to remove hydrogen sulfide, White employs a scrubber containing a solution of sodium carbonate. Also at the high operating temperature of 1000°C of White, sodium losses are very high thus requiring higher makeup requirement and expensive equipment.

The oxygen is supplied to the coal in an amount sufficient to convert substantially all of the carbon present in the coal to carbon monoxide but insufficient to convert the carbon present to carbon dioxide and generally in an atomic ratio of oxygen to carbon present in carbonaceous fuel of 1:1 to 1:5. and preferably 1:1 to 1:3.

The metal compound which is a metal oxide, hydroxide, bicarbonate or carbonate is added to the carbonaceous fuel in at least an amount sufficient to react with the sulfur and halogens present in the carbonaceous fuel. The compound of the metal is preferably added in a slight stoichiometric excess over that necessary to convert all of the sulfur and halogens to the metal sulfide and metal halides, and generally in an atomic ratio of metal in metal compound to sulfur and halogens in carbonaceous fuel of not less than 2:1, but preferably between 2:1 and 10:1 and most preferably between 2:1 and 6:1.

The oxygen can be supplied to the reaction zone as pure oxygen, but is preferably supplied as atmospheric air.

According to one aspect of the present invention, there is provided a novel reactor. Referring to the drawings, there is shown a combined cocurrent and countercurrent reactor 10. The reactor 10 has a cocurrent section 21 comprising a conduit 22 having substantially vertical sides 23. The cocurrent section 21 is also provided with a solids inlet conduit 24 discharging to the upper end 25 of the cocurrent section 21. The cocurrent section 21 also has a first gas inlet 12 in communication with the upper end 25 of the cocurrent section 21. In this manner, solids flow downward in the conduit 22 under the influence of gravity. Gas from the gas inlet 12 flows in a direction cocurrent to the flow of solids, as shown by the arrow 27. The reactor 10 is also provided with a countercurrent section 28. The countercurrent section has a diameter $D_1$ which is substantially greater than the diameter $D_2$ of the conduit 22 of the cocurrent section 21. The countercurrent section 28 has walls 29 which extend above the bottom 30 of the conduit 22. The walls 29 are attached to the conduit 22 at a point above the bottom 30 of the conduit 22. In the bottom of the countercurrent section 28 there is provided a grate 31 supporting the solids 32 in the countercurrent section 28. The countercurrent section 28 is provided with a second gas inlet 14 at a point below the grate 31. Gas enters through the inlet line 14 and flows through the gas permeable grate 31 in the direction of the arrow 33. The countercurrent section 28 is also provided with an outlet line 46 by which gases are removed from the reactor 10. By virtue of this novel design, gases leaving the reactor 10 via the gas outlet line 46 are in thermal equilibrium with the upper surface 34 of the solids 32 present in the countercurrent section 28.

The reactor of the present invention when employed in the process of the present invention has a number of advantages over both countercurrent reactors and cocurrent reactors. An exemplary countercurrent reactor is shown in White. As shown in FIG. 3 of White, the highest temperature of approximately 1000°C is obtained in zone 2, whereas because of countercurrent flow of the gases, the temperature in White's zone 5 is approximately one half of this value. At temperatures in the vicinity of 500°C the undesirable synthesis of hydrogen sulfide is favored, which accounts at least in part for the provision in White of a sodium carbonate absorber. This external scrubber is required in White notwithstanding the presence in White of sodium carbonate mixed with his carbonaceous fuel. A simple cocurrent reactor has the disadvantage that the flow of gas in the same direction as the flow of solids tends to pack the solids and inhibit gas flows. Further, it is virtually impossible to consume all the carbon in a cocurrent reactor, so some carbon is always left unreacted. In the case of a reaction of a carbonaceous fuel with steam and oxygen, this packing tends to inhibit the reaction. The combined countercurrent-cocurrent reactor of the present invention overcomes all of these disadvantages.

In order to more fully understand the present invention, reference is now made to the drawing showing an apparatus employing a reactor of the present invention and showing additional elements suitable for practicing the process of the present invention.

This arrangement comprises a cocurrent-countercurrent reactor 10 having gas inlet lines 12 and 14 and a solids inlet line 16 which is provided with an airlock 18 and an inlet line 20. The inlet lines 12 and 14 are respectively in communication with blowers 13 and 15. The products from reactor 10 are discharged through an outlet line 46 and a solids outlet line 42, which is in communication with the solids conduit 35 and valve 44. The solids outlet line 42 is in communication with a countercurrent reactor 48.

The countercurrent reactor 48 is also provided with a grate 49 supporting solids 53, inlet lines 50 and 52 and outlet lines 54 and 56. The outlet line 56 is an inlet line to a leaching chamber 60. The inlet line 50 is provided with an airlock 51 and the outlet line 54 is provided with a valve 55.

In addition to the line 56, the leaching chamber 60 is equipped with an inlet line 62 and an agitator 66. The agitator 66 is run by a motor (not shown). The leaching chamber 60 is in communication with a continuous tubular centrifuge 72 via line 74 and valve 76. The solids from the centrifuge are pumped via solids outlet line 78 with the aid of valve 81. The continuous tubular centrifuge 72 is provided with a liquids outlet line 82 having a valve 80. The line 82 serves as an inlet line to the cooler-crystallizer 84.

The solids from cooler crystallizer 84 are carried through valve 86 and line 20 to the cocurrent-countercurrent reactor 10. The liquids fom cooler-crystallizer 84 are pumped to the leaching tank 60 via valve 88 and line 64.

The fuel gases supplied via line 46 from reactor 10 are utilized for various purposes depending on the composition of the fuel gases and the demand. For instance, the fuel gases are used to produce steam, to generate electricity, to heat buildings, to produce producer gas, to produce hydrogen, to produce controlled temperature ranges, and to pre-heat materials used in the industrial operations. If it is just burning some refuse, the flue gases evolved will be devoid of all pollutants such as sulfur, halogens and particulate matter. As a result, these gases can be let out into the atmosphere after using up the heat. A particular use of the combustible gases produced in reactor 10 is described below for generating electricity.

The hot combustible gases from the reactor 10 are fed via line 46 to a burner 90 to supply heat to a boiler 92 which is provided with an outlet line 94. A portion of the steam from line 94 is supplied to reactor 10 via line 96 and valve 98. A portion of the combustion gases from burner 90 are fed to reactor 10 via lines 12 and 14.

The steam from boiler 92 is supplied via line 94 to turbine 100 to generate electricity in power generator 102.

The additives —sodium carbonate, coal, air and steam — via inlet lines 12, 14, and 16 into the cocurrent-countercurrent reactor 10 react at temperatures 750° to 850°C in accordance with equations 1 through 9:

| | |
|---|---|
| $C + 1/2O_2 - CO$ | Eq. (1) |

-continued

| | |
|---|---|
| $C + O_2 - CO_2$ | Eq. (2) |
| $CO_2 + C - 2CO$ | Eq. (3) |
| $C + H_2O - CO + H_2$ | Eq. (4) |
| $S + O_2 - SO_2$ | Eq. (5) |
| $SO_2 + Na_2CO_3 - Na_2SO_3 + CO_2$ | Eq. (6) |
| $Na_2SO_3 - Na_2S + 3/2\ O_2$ | Eq. (7) |
| $Na_2S + 3/2\ O_2 - Na_2SO_3$ | Eq. (8) |
| $Na_2SO_3 + 1/2\ O_2 - Na_2SO_4$ | Eq. (9) |

to generate hot combustible gas comprising carbon monoxide, hydrogen and steam containing minor amounts of carbon dioxide; and solid products are ash, sodium sulfide, sodium sulfite, and sodium sulfate. The gaseous products, free of sulfur, halogens sulfur, halognes and particulate matter, from reactor 10 are removed via outlet line 46.

The solid products and unreacted sodium carbonate of reactor 10 are carried through the valve 44 and line 42 to the countercurrent reactor 48 where they react with coal, water vapor or steam and air supplied via inlet lines 50 and 52 at a temperature of 200° to 650°C, preferably 300° to 550°C and under a pressure of 0 to 150 psig, preferably 0 to 50 psig giving rise to reactions represented by equations 1, 1, 4, and 10 through 14:

| | |
|---|---|
| $H_2 + 1/2\ O_2 - H_2O$ | Eq. (10) |
| $CO + O_2 - CO_2$ | Eq. (11) |
| $Na_2S + CO_2 + H_2O - Na_2CO_3 + H_2S$ | Eq. (12) |
| $Na_2SO_3 + 2H_2 + CO - Na_2CO_3 + H_2S + H_2O$ | Eq. (13) |
| $Na_2SO_4 + H_2 + CO - Na_2CO_3 + H_2S + O_2$ | Eq. (14) |

to produce crude hydrogen sulfide, sodium carbonate and ash. The above stated reactions in reactor 48 take place when the atomic ratio of oxygen in air to carbon in coal is between 1:1 and 1:3 and the molar ratio of metal sulfide to carbon in coal is between 1:3 and 1:10. The crude hydrogen sulfide is removed via outlet line 54 to produce sulfuric acid or elemental sulfur using either contact or Claus' process or any other industrial process generally governed by economic and marketing considerations.

The solid products from countercurrent reactor 48 are charged tothe leaching tank 60 via valve 58 in connection with a line 56. These solids are contacted with water at 25°C to 100°C pumped from line 62 using an agitator 66 to dissolve sodium carbonate thus enabling its separation from ash in the continuous tubular centrifuge 72.

The sodium carbonate solution containing ash is conveyed via line 74 provided with a valve 76 to the continuous tubular centrifuge 72. The ash is dumped to waste via solids outlet line 78 and valve 81. The liquids from continuous tubular centrifuge 72 are passed on to the cooler-crystallizer 84 via line 82.

The sodium carbonate crystallized at 0° to 40°C in cooler-crystallizer 84 is recycled with the charge to the cocurrent-countercurrent reactor 10 via line 20 in communication with the inlet line 16. The supernatant liquid from the cooler-crystallizer 84 is pumped back to the leaching tank 60 via line 64.

Although the invention has been described in considerable detail with reference to certain preferred embodiments thereof, it will be understood that variations and modifications can be effected within the spirit and scope of the invention as described above and as defined in the appended claims.

I claim:

1. A process for producing hot gas having 10 to 400 BTU/ft$^3$ content and devoid of sulfur, halogens and particulate matter comprising the steps of:

I. reacting at 750° to 850°C a sulfur-bearing coal, air, steam, and, a metal compound selected from the group consisting of sodium oxide, sodium hydroxide, sodium bicarbonate, sodium carbonate and mixtures thereof, to produce sodium sulfide, wherein A. the atomic ratio of oxygen present in air to carbon in coal is between 1:1 and 1:3, and B. the atomic ratio of metal in the metal compound to sulfur in coal is not less than 2:1, II. reacting the sodium sulfide produced from Step I with additional coal, additional air and steam at 200° to 650°C to regenerate sodium carbonate, wherein A. the atomic ratio of carbon in coal to oxygen in air is between 1:1 and 3:1, and B. the molar ratio of the sodium sulfide to carbon in the coal is between 1:3 and 1:10.

2. A process for producing hot combustible gas with low BTU content and free of sulfur, halognes and particulate matte comprising the steps of:

I. reacting in a reacting zone at 750° to 850°C a sulfur contaminated coal, air, steam, and a metal compound selected from the group consisting of sodium oxide, sodium hydroxide, sodium bicarbonate, sodium carbonate and mixtures thereof to produce sodium sulfide and sulfur-free hot combustible gas, amount of metal compound being sufficient so that substantially all of the sulfur is reacted to sodium sulfide, II. conveying the sodium sulfide to a second reacting zone, III. reacting in the second reactng zone the sodium sulfide produced in Step I with additional coal, air and steam at 200° to 650°C to produce crude hydrogen sulfide, coal ash and sodium carbonate, Iv. leaching the sodium carbonate and coal ash with water to produce sodium carbonate solution and insoluble coal ash, V. separating the sodium carbonate solution, from the insoluble coal ash, VI. cooling the sodium carbonate solution to produce crystalline sodium carbonate and a supernatant mother liquor, VII. recycling the crystalline sodium carbonate to Step I, and VIII. recycling the supernatant mother liquor to Step IV.

3. A process for producing hot combustible gases with low BTU content and free of sulfur, halogens and particulate matter comprising the steps of:

I. reacting in a first reacting zone at 750° to 850°C

A. coal contaminated with sulfur,

B. sodium carbonate,

C. air,

D. steam,

E. carbon dioxide, wherein

F. the atomic ratio of metal in B to sulfur in A is 2:1 to 10:1,

G. the pressure of the first reacting zone is 0 to 50 psig,

H. the atomic ratio of oxygen in the air to carbon in A is 1:1 to 1:5, to produce:

I. sodium sulfide,

J. a hot combustible gas comprising carbon monoxide and hydrogen,

K. ash,

II. conveying the sodium sulfide and ash to a second reacting zone,

III. reacting at 200° to 650°C in the second reacting zone

A. sodium sulfide and ash from Step I,

B. additional coal,

C. air,

D. steam, wherein:

E. the pressure of the second reacting zone is 0 to 150 psig,

F. the molar ratio of A to carbon in B is 1:3 to 1:10,

G. the atomic ratio of oxygen in air to carbon in coal is 1:1 to 3:1,

H. crude hydrogen sulfide,

I. sodium carbonate,

J. ash,

IV. removing the crude hydrogen sulfide,

V. leaching the solid sodium carbonate and insoluble ash with water at 25° to 100°C to produce:

A. sodium carbonate solution,

B. ash,

VI. separating the sodium carbonate solution from the ash

VII. crystallizing the sodium carbonate solution from Step VI by cooling at 0° to 40°C to produce:

A. crystalline sodium carbonate, and

B. supernatant mother liquor,

VIII. recycling the crystalline sodium carbonate from Step VII to Step I, and

IX. recycling and supernatant mother liquor from Step VII to Step V.

4. The process of claim 1 wherein the molar ratio of carbon dioxide to the carbon in the coal is between 1:50 and 1:200.

* * * * *